United States Patent [19]

Borst

[11] 4,295,833

[45] Oct. 20, 1981

[54] INBOARD-OUTBOARD DRIVING MECHANISM INCLUDING A HYDRAULICALLY ASSISTED STEERING SYSTEM

[75] Inventor: Gaylord M. Borst, Waukegan, Ill.

[73] Assignee: Outboard Marine Corporation, Waukegan, Ill.

[21] Appl. No.: 953,566

[22] Filed: Oct. 23, 1978

[51] Int. Cl.[3] ..... B63H 1/14; B63H 5/06; B63H 25/42

[52] U.S. Cl. ..... 440/63; 440/58; 440/61; 91/368; 114/144 R; 114/150

[58] Field of Search ..... 91/368, 376 R, 420; 74/388 R, 388 PS; 114/144 R, 150; 115/18 R, 34 R, 35; 92/140; 440/53-65

[56] References Cited

U.S. PATENT DOCUMENTS

| | | | |
|---|---|---|---|
| 2,928,377 | 3/1960 | Ford | 114/150 |
| 3,148,657 | 9/1964 | Horning | 114/150 |
| 3,183,880 | 5/1965 | Shimanckas | 115/34 R |
| 3,631,833 | 1/1972 | Shimanckas | 115/18 R |
| 3,654,889 | 4/1972 | Bergstedt | 115/35 |
| 3,752,248 | 8/1973 | Stevens | 91/368 |
| 3,799,102 | 3/1974 | Smith | 115/18 R |

*Primary Examiner*—Trygve M. Blix

*Assistant Examiner*—D. W. Keen

*Attorney, Agent, or Firm*—Michael, Best & Friedrich

[57] ABSTRACT

Disclosed herein is an inboard-outboard driving mechanism for a boat having a hull, the driving mechanism including a support adapted to be fixed relative to the boat hull, an engine mounted on of the support, a propulsion leg including a rotatably mounted propeller, and structure for connecting the propulsion leg to the support for pivotal steering movement about a steering axis. The inboard-outboard driving mechanism also includes apparatus for causing pivotal steering movement of the propulsion leg including a steering shaft rotatably journaled in the support, and gearing connecting the steering shaft and the propulsion leg for pivoting the propulsion leg in response to rotation of the steering shaft. The steering shaft is selectively rotated by a lever mounted on the engine for pivotal movement and having opposite ends, one of the ends being connected through a gear box to the steering shaft. A fluid motor mounted on the engine is connected to the other end of the lever, and the fluid motor is actuated by a fluid valve. The fluid valve is in turn actuated by movement of a conduit of a steering cable. The steering cable core is also connected through a rigid link to the lever for assisting pivotal movement of the lever.

9 Claims, 4 Drawing Figures

INBOARD-OUTBOARD DRIVING MECHANISM INCLUDING A HYDRAULICALLY ASSISTED STEERING SYSTEM

BACKGROUND OF THE INVENTION

The invention relates to marine steering systems and particularly to power actuated steering systems for marine propulsion devices such as stern drive units.

In the past, various arrangements have been utilized to effect steering movement of the outdrive unit of an inboard-outboard marine propulsion device. An example of such a steering arrangement is illustrated in the U.S. Shimanckas Pat. No. 3,183,880, issued May 18, 1965 and assigned to the assignee of the present invention.

Attention is also directed to the U.S. Ford Pat. No. 2,928,377, issued March 15, 1960; the U.S. Horning Pat. No. 3,148,657, issued Sept. 15, 1964; the U.S. Stuteville Pat. No. 3,302,604, issued Feb. 7, 1967; and the U.S. Stuteville Pat. No. 3,384,046, issued May 21, 1968.

Attention is further directed to the U.S. Shimanckas Pat. No. 3,631,833, issued Jan. 4, 1972; the U.S. Borst et al Pat. No. 3,863,593, issued Feb. 4, 1975; and the U.S. Kroll et al Pat. No. 3,922,995, issued Dec. 2, 1975.

SUMMARY OF THE INVENTION

The invention generally includes an inboard-outboard driving mechanism wherein a power assisted apparatus is provided for causing steering movement of an outdrive unit of a marine inboard-outboard. The invention also provides a powder assisted means for causing steering movement of an outdrive unit having a worm gear driven rotatable propulsion leg as shown in the U.S. Shimanckas patent referred to above.

The invention includes an inboard-outboard driving mechanism for a boat, the driving mechanism including a support adapted to be fixed relative to a boat hull, a propulsion leg including a rotatably mounted propeller, and means connecting the propulsion leg to the support for pivotal steering movement about a steering axis. The driving mechanism also includes means for causing pivotal steering movement of the propulsion leg, the steering means including a steering shaft rotatably journaled in the support, means connecting the steering shaft and the propulsion leg for pivoting the propulsion leg in response to rotation of the steering shaft, and fluid pressure actuated means for causing rotation of the steering shaft.

One of the principal features of the invention is the provision in the fluid pressure actuated means for causing rotation of the steering shaft of a lever mounted for pivotal movement and having opposite ends, one of the ends of the lever being connected to the steering shaft, a fluid motor connected to the other of the ends of the lever, and means for actuating the fluid motor for causing pivotal movement of the lever.

Another of the principal features of the invention is the provision of a fluid pump connected to the fluid motor, a steering cable including a conduit and an inner core longitudinally slidable in the conduit, and means for controlling fluid flow from the fluid pump to the fluid motor including selectively actuatable valve means, one of the inner core and the conduit being connected to the valve means for actuating the valve means.

Another of the principal features of the invention is the provision of a rigid link member, one end of the link member being connected to the lever and the other end of the link member being connected to the other of the inner core and the conduit of the steering cable.

The invention also includes an inboard-outboard driving mechanism for a boat, the driving mechanism including an engine and a propulsion leg having a rotatably mounted propeller and being supported for pivotal steering movement. The driving mechanism also includes a gear box having a rotatable output shaft operably connectable to the propulsion leg for causing pivotal steering movement of the propulsion leg, a rotatable input shaft, and gear means connecting the input shaft and the output shaft for causing rotatable movement of the output shaft in response to rotation of the input shaft. A lever is connected to the input shaft and is pivotably movable for causing rotation of the input shaft, and means are further provided for causing pivotal movement of the lever.

The invention also includes an inboard-outboard driving mechanism for a boat having a hull and having a support adapted to the fixed relative to the hull, the driving mechanism including an engine supported by the support, a propulsion leg having a rotatably mounted propeller and being supported by the support for pivotal steering movement, and means for drivingly connecting the engine to the propulsion leg. The invention also includes a gear box mounted on the engine and including a rotatable output shaft operably connected to the propulsion leg for causing pivotal steering movement of the propulsion leg, a rotatable input shaft, and gear means connecting the input shaft and the output shaft for causing rotatable movement of the output shaft in response to rotation of the input shaft. A lever is connected to the input shaft for causing rotation of the input shaft, and means are further provided for causing movement of the lever including a fluid motor mounted on the engine and connected to the lever.

Other features and advantages of the invention will become known by reference to the following description, to the appended claims, and to the drawings.

Figure 1:
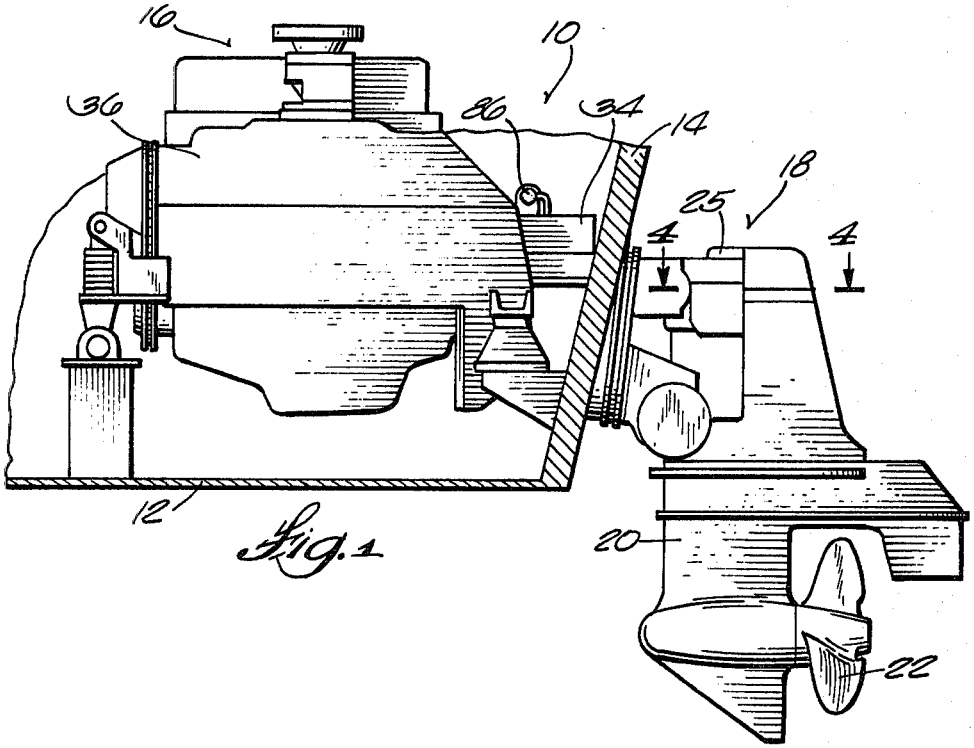
FIG. 1 is a fragmentary, side elevational view, partially in section, of a boat including a stern drive unit incorporating various of the features of the invention.

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Figures 3, 4:
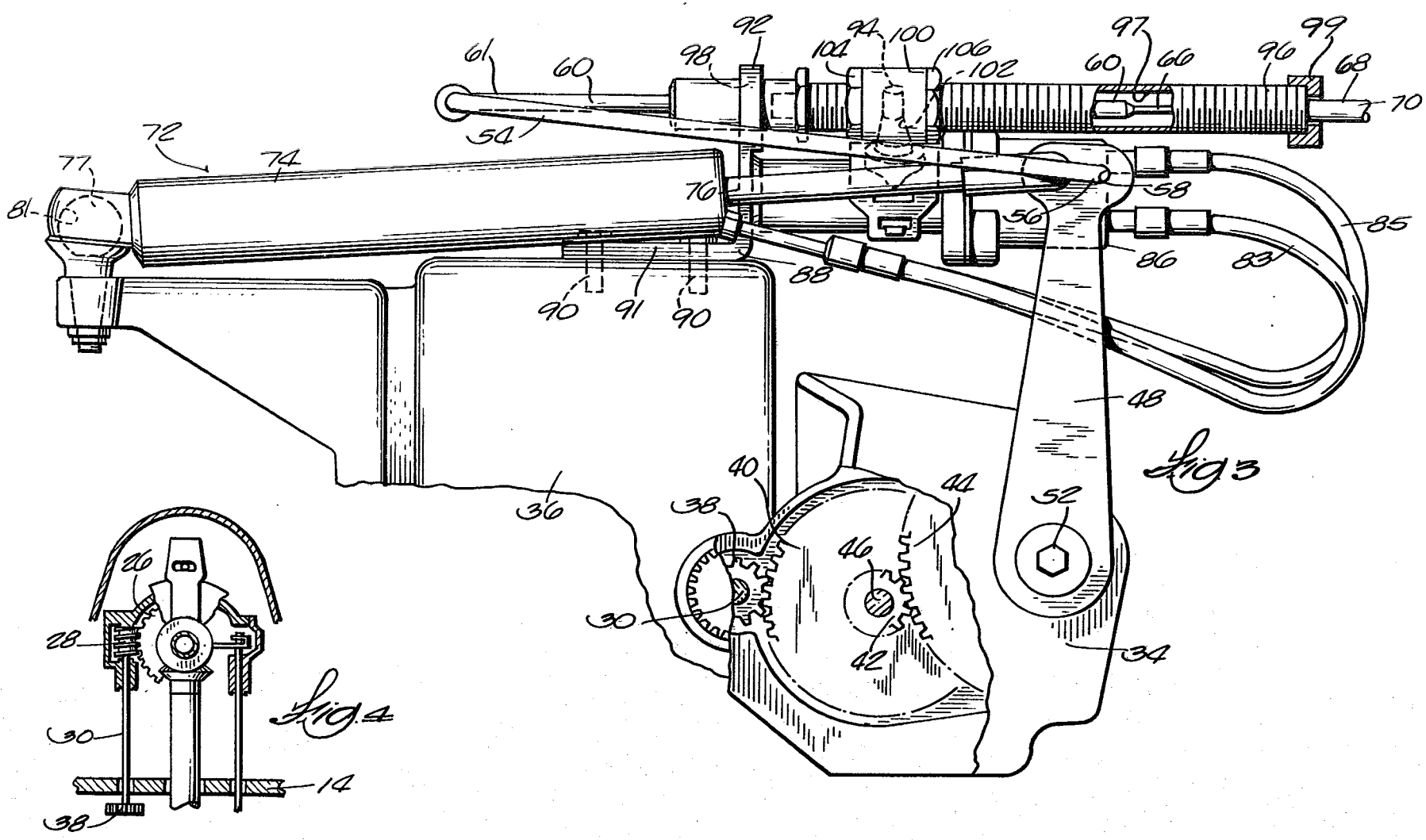
FIG. 3 is an enlarged fragmentary rear elevation view of a portion of the stern drive unit shown in FIG. 1 with portions broken away in the interest of clarity and showing the steering system power assisted actuated means.
FIG. 4 is a cross section view taken along line 4-4 in FIG. 1.

Illustrated in the drawings is an inboard-outboard marine propulsion unit 10 supported by a hull 12 and a transom 14 of a boat. The inboard-outboard unit 10 includes an engine 16 supported by the hull 12 forward of the transom 14, and a propulsion leg 18 connected to the engine 16 and including a lower unit 20 which rotatably supports a propeller 22 and which is horizontally swingable or pivotable relative to the engine 16 to provide for steering. While various propulsion leg constructions can be provided, in the illustrated construction the propulsion leg 18 is constructed in general accordance with the disclosure of the U.S. Shimanckas Pat. No. 3,183,880, issued May 18, 1965 and entitled "Marine Propulsion Device". While the construction and operation of the propulsion leg 18 and the means for supporting the propulsion leg for pivotal steering movement will be briefly described, reference can be made to the Shimanckas patent for a more detailed description. Referring to FIG. 4, the means for providing for steering movement of the propulsion leg 18 includes a worm gear 26 rigidly connected to the lower unit 20 for rotation therewith. A worm 28 is attached to the end of a rotatable steering shaft 30 and engages the worm gear 26 and is effective to cause rotation of the worm gear 26 and the propulsion leg 18 in response to rotation of the steering shaft 30.

The inboard-outboard unit 10 further includes means for providing power assisted steering movement of the propulsion leg. Such means includes fluid pressure actuated means connected to the steering shaft 30 and for providing for power assisted rotation of the worm 28 in response to rotation of the steering wheel 32, illustrated schematically in FIG. 2. While various arrangements can be provided, in the illustrated construction, the fluid pressure actuated means for providing for rotation of the steering shaft 30 includes a plurality of gears operably connected in meshing relationship and housed within a gear box 34 (FIG. 3), the gear box 34 being mounted on the engine block 36 of the engine 16. The gears housed therein include an output gear 38 on an end of the steering shaft 30 opposite the end supporting the worm 28, the output gear 38 providing means for driving the steering shaft 30. The gears also include a pair of reduction gears 40 and 42, mounted on a shaft 46, and a sector shaped input gear 44 mounted on a shaft 50 for rotation therewith. The small diameter gear 42 of the reduction gears is in meshing engagement with the sector shaped input gear 44 and is suitably secured to the shaft 46 for rotation with that shaft. The large diameter gear 40 of the reduction gears is also suitably secured to the shaft 46 for rotation therewith and is rotatably driven by the small diameter gear 42 through the shaft 46. The large diameter gear 40 meshes with the output gear 38 to drive the output gear 38 and the steering shaft 30.

The fluid pressure actuated means for providing for rotation of the steering shaft 30 further includes means for causing limited rotational movement of the sector shaped input gear 44. While various arrangements. can be provided, in the illustrated construction, a lever 48 is mounted on the shaft 50 for providing for rotation of that shaft. Since the sector shaped input gear 44 is supported for rotation with the shaft 50, pivotal movement of the lever 48 causes simultaneous pivotal movement of the input gear 44. More particularly, as shown in the construction illustrated in FIG. 3, the shaft 50 includes an end extending outwardly through the gear box housing 34. The lower end of the lever 48 is fixedly attached to the projecting end of the shaft 50 by means of a bolt 52. In the illustrated construction, the reduction gears 40 and 42, the sector shaped input gear 44, and the output gear 38 have corresponding sizes such that movement of the upper end of the lever 48 of a distance of approximately 8 inches is intended to result in approximately five revolutions of the output gear 38 and the steering shaft 30. Such rotation of the steering shaft 30 is intended to provide for pivotal movement of the lower unit 20 of the propulsion unit 18 through an arc of 90°.

The fluid pressure actuated steering means also includes power assist means for effecting pivotal movement of the lever 48. While various arrangements can be provided, in the illustrated construction, the power assist means includes a linear fluid motor 72 including a cylinder 74 having one end pivotally connected to the engine block 36 and including a piston 76 disposed in the cylinder 74. The cylinder 74 is pivotally supported by a ball 77 extending upwardly from the engine block 36 and pivotably received in a recess 81 in an end of the cylinder. The piston 76 includes an end projecting from the cylinder 74 and connected through a bore 78 to the upper end of the lever 48. The piston 76 and cylinder 74 are connected between the lever 48 and the engine block 36 in such a manner that reciprocal movement of the piston 76 in the cylinder 74 causes pivotal movement of the lever 48. To provide for such reciprocal movement of the piston 76, hydraulic fluid is conveyed to the cylinder 74 from a pump 80 through fluid conduits 83 and 85. The pump can be a conventional power steering pump, driven for example, by the engine 16.

Means are also provided for controlling actuation of the fluid motor 72 in response to movement of the steering wheel 32. While various arrangements can be provided, in the illustrated construction, a fluid valve 86 is rigidly mounted on the engine block 36 by a bracket 88 (FIG. 3). The bracket 88 has an L-shaped configuration and includes a planar lower portion positionable against the block 36 and secured thereto by a pair of bolts 90. The bracket 88 also includes an upwardly extending arm or portion 92, perpendicular to the lower planar portion 91. In the illustrated construction, fluid valve 86 is a conventional spool valve of the type for use in controlling actuation of fluid motors used, for example, in power steering systems, and includes a transversely projecting pivotable control stem 94. In operation, when the pivotable stem 94 is positioned as shown in FIG. 3, fluid supplied through conduit 82 is returned to the pump 80 through conduit 84 and is not supplied to the fluid motor 72. However, when pivotable stem 94 is moved to the left or to the right as viewed in FIG. 3, fluid flow is selectively provided through either the conduit 83 or the conduit 85 to cause selective extension or retraction of the piston 76 of the fluid motor 72. In the illustrated construction the steering wheel 32 is connected through a rotatable shaft 62 and a pivotable lever 64, mounted on the end of the rotatable shaft 62, to the core 66 of a steering cable 68. The lever 64 is rigidly connected to and extends radially from the rotatable shaft 62 for pivotable movement about the axis of the shaft 62 in response to rotation of the steering wheel 32. The core 66 is attached to the radially outer end of the pivotable lever 64. The outer sleeve or conduit 70 of the cable 68 is fixed at its end adjacent the shaft 62 by a bracket 69. Accordingly, rotation of the steering wheel 32 and consequent movement of the outer end of the lever 64 causes relative slidable movement of the core 66 within the conduit 70.

In the illustrated construction, the end of the conduit 70 of the steering cable 68 opposite that end connected to the bracket 69 is connected to a rigid sleeve or tube 96 by a collar 99. The sleeve 96 is in turn supported for reciprocal slidable movement in a circular bore 98 in the upwardly extending end of the arm 92 of the bracket 88. A collar 100 surrounds the sleeve 96 and is threadably supported on the sleeve for reciprocal movement with the sleeve. The collar 100 includes a radially extending bore 102 therein intermediate its opposite ends, the bore 102 housing the upper end of the pivotable valve actuating stem 94. Reciprocal movement of the sleeve 96 and the collar 100 will thus cause transverse movement of the upper end of the valve actuating stem 94 to thereby selectively actuate the fluid valve 86. The collar 100 is adjustably supported on the sleeve 96 by a pair of nuts 104 and 106 threadably supported on the sleeve 96 and abutting the opposite longitudinal ends of the collar 100.

Figure 2:
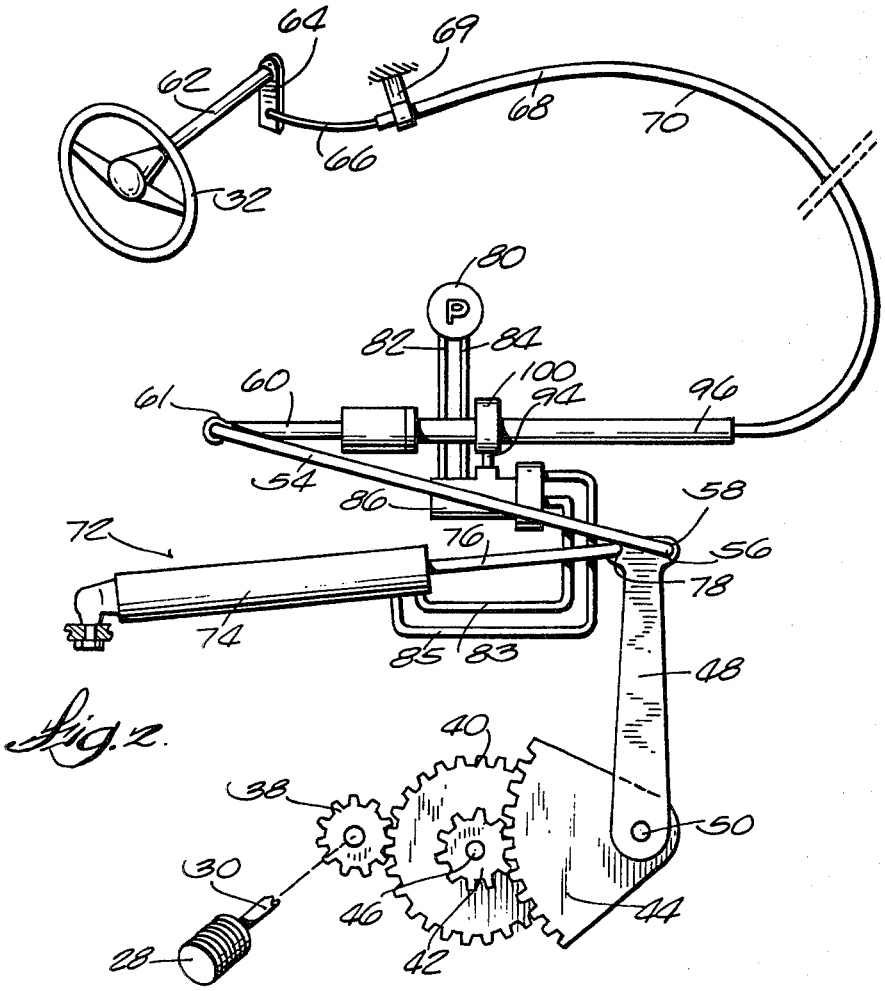
FIG. 2 is a schematic view of the steering system incorporated in the boat and stern drive unit shown in FIG. 1.

The sleeve 96 further includes a central longitudinal bore 97 slidably supporting a rigid rod 60 therein. The rod 60 has one of its ends connected to an end of the core 66 of the steering cable 68 such that relative slidable movement of the core 66 in the conduit 70 of the steering cable will cause relative sliding movement of the rod 60 within the bore 97 of the sleeve 96. The rod 60 also includes a free end 61 projecting from the end of the sleeve 96 and connected to the lever 48 by a rigid drag link or rod 54. In the illustrated construction, the drag link 54 includes an angular end 56 projecting through a bore 58 in the upper end of the lever 48. The opposite end of the drag link 54 is connected to the free end 61 of the rod 60. As shown in FIGS. 2 and 3, the rod 60 is supported in the sleeve 96 for reciprocal movement in a direction generally parallel to the direction of permissable movement of the upper end of the lever 48.

In operation, rotatable movement of the steering wheel 32 and consequent movement of the lever 64 will cause relative movement of the central core 66 and the conduit 70 of the flexible cable 68. The resultant relative slidable movement of the respective ends of the core 66 and the conduit 70 will tend to cause relative sliding movement of the rod 60 and the sleeve 96. Since the lever 48 and the link 54 will resist and tend to prevent movement of the rod 60, the sleeve 96 will be caused to move longitudinally, thereby causing pivotal movement of the valve actuating stem 94 and actuation of the spool valve 86 and consequent actuation of the fluid motor 72. Movement of the piston 76 will then cause movement of the lever 48, rotation of the steering shaft 30, and consequent pivotal steering movement of the outdrive unit 18.

The fluid conduits 83 and 85 are connected to the cylinder 74 such that movement of the sleeve 96 and the actuating stem 94 to the right as seen in FIGS. 2 and 3 will cause retraction of the piston 76 and movement of the upper end of the lever 48 and the drag link 54 to the left. Such movement of the drag link 54 in response to actuation of the fluid valve 86 results in movement of the rod 60 and the sleeve 96 to the left, thereby causing the valve stem 94 to return to its neutral position. Additional movement of the steering wheel 32 is therefore required for continued pivotal movement of the lever 48 and further steering movement of the lower unit 20. Similarly, movement of the sleeve 96 to the left causes extension of the fluid motor 72 and movement of the drag link 54 to the right. Such movement of the drag link 54 causes movement of the rod 60 and the sleeve 96 to the right, thereby causing the valve stem 94 to return to its neutral position.

In the event of failure of the fluid actuated power assist mechanism, the link 54 and cable 68 also provide a mechanical connection between the lever 48 and the steering wheel 32. Accordingly, the inboard-outboard drive mechanism can be controlled despite loss of power.

Various of the features of the invention are set forth in the following claims.

What is claimed is:

1. An inboard-outboard driving mechanism for a boat, said mechanism including a support adapted to be fixed relative to a boat hull, a propulsion leg including a rotatably mounted propeller, means connecting said propulsion leg to said support for pivotal steering movement about a steering axis, and means for causing pivotal steering movement of said propulsion leg including a steering shaft having a second axis transverse to said steering axis and rotatably journaled in said support, means connecting said steering shaft and said propulsion leg for pivoting said propulsion leg in response to rotation of said steering shaft, a lever mounted for pivotal movement about an axis transverse to said steering axis and having a first end and a second end, gear means connecting said first end of said lever and said steering shaft and operable, in response to rotation of said lever, to rotate said steering shaft at an angular rate greater than the rate of rotation of said lever, a fluid motor connected to said second end of said lever, and means for actuating said fluid motor to cause pivotal movement of said lever.

2. An inboard-outboard driving mechanism for a boat, said mechanism including a support adapted to be fixed relative to a boat hull, a propulsion leg including a rotatably mounted propeller, means connecting said propulsion leg to said support for pivotal steering movement about a steering axis, and means for causing pivotal steering movement of said propulsion leg including a steering shaft rotatably journaled in said support, means connecting said steering shaft and said propulsion leg for pivoting said propulsion leg in response to rotation of said steering shaft, a lever mounted for pivotal movement and having a first end connected to said steering shaft and a second end, a fluid motor connected to said second end of said lever, a fluid pump, a steering cable including a conduit and an inner core longitudinally slidable in said conduit, means for controlling fluid flow from said fluid pump to said fluid motor including selectively actuatable valve means connected to one of said inner core and said conduit for actuating said valve means, and a rigid link member having a first end connected to said second end of said lever and having a second end connected to the other of said inner core and said conduit.

3. In an inboard-outboard driving mechanism for a boat and including an engine and a propulsion leg having a rotatably mounted propeller and being supported for pivotal steering movement about a steering axis, a gear box including an output shaft rotatable about a second axis transverse to said steering axis and operably connectable to the propulsion leg for causing pivotal steering movement of the propulsion leg, an input shaft rotatable about a third axis parallel to said second axis, and gear means connecting said input shaft and said output shaft for causing rotary movement of said output shaft in response to rotation of said input shaft, a lever fixedly connected to said input shaft for causing rotation of said input shaft, said lever including opposite ends, one of said lever ends being connected to said input shaft, and means for causing pivotal movement of said lever including a fluid motor connected to the other of said lever ends, and means for selectively actuating said fluid motor including a steering cable having a condut and an inner core longitudinally movable in said conduit, and a rigid link member having opposite ends, one of said link member ends being connected to said lever and the other of said link member ends being connected to one of said conduit and said inner core.

4. An inboard-outboard driving mechanism for a boat having a hull, said mechanism including a support adapted to be fixed relative to a boat hull, an engine mounted on said support, a propulsion leg including a rotatably mounted propeller, means connecting said propulsion leg to said support for pivotal steering movement about a steering axis, and means for causing pivotal steering movement of said propulsion leg including a steering shaft rotatably journaled in said support, means connecting said steering shaft and said propulsion leg for pivoting said propulsion leg in response to rotation of said steering shaft, and means for causing rotation of said steering shaft including a lever mounted on said engine for pivotal movement and having a first end connected to said steering shaft and a second end, a fluid motor mounted on said engine and connected to said second end of said lever, a steering cable including a conduit and an inner core longitudinally slidable in said conduit, and means for controlling fluid flow to said fluid motor including a selectively actuatable valve means connected to one of said inner core and said conduit for actuating said valve means, and a rigid link member having a first end connected to said second end of said lever and having a second end connected to the other of said inner core and said conduit.

5. An inboard-outboard driving mechanism for a boat as set forth in claim 4 and further including a gear box mounted on said engine, said gear box including a plurality of gears in meshing relation, one of said gears being connected to said lever and rotatable in response to pivotal movement of said lever, and another of said gears being an output gear and being connected to said steering shaft for causing rotation of said steering shaft in response to rotation of said other of said gears.

6. In an inboard-outboard driving mechanism for a boat and including an engine and a propulsion leg having a rotatably mounted propeller and being supported for pivotal steering movement about a steering axis, a gear box including an output shaft rotatable about a second axis transverse to said steering axis and operably connectable to the propulsion leg for causing pivotal steering movement of the propulsion leg, an input shaft rotatable about a third axis parallel to said second axis, and gear means connecting said input shaft and said output shaft and operable, in response to rotation of said input shaft, to rotate said output shaft at an angular rate greater than the rate of rotation of said input shaft, a lever fixedly connected to said input shaft for causing rotation of said input shaft, and means for causing pivotal movement of said lever.

7. The apparatus as set forth in claim 6 wherein said lever includes opposite ends, one of said lever ends being connected to said input shaft, and wherein said means for causing movement of said lever includes a fluid motor connected to the other of said lever ends, and means for selectively actuating said fluid motor.

8. The apparatus as set forth in claim 7 wherein said means for selectively actuating said fluid motor includes valve means supported by the engine, and wherein said means for causing movement of said lever includes a steering cable having a conduit and an inner core longitudinally movable in said conduit, one of said conduit and said inner core being connected to said valve means for actuating said valve means.

9. In an inboard-outboard driving mechanism for a boat and including an engine and a propulsion leg having a rotatably mounted propeller and being supported for pivotal steering movement about a steering axis, a gear box including an output shaft rotatable about a second axis transverse to said steering axis and operably connectable to the propulsion leg for causing pivotal steering movement of the propulsion leg, an input shaft rotatable about a third axis parallel to said second axis, and gear means connecting said input shaft and said output shaft for causing rotary movement of said output shaft in response to rotation of said input shaft, a lever fixedly connected to said input shaft for causing rotation of said input shaft, said lever including opposite ends, one of said lever ends being connected to said input shaft, and means for causing pivotal movement of said lever including a fluid motor connected to the other of said lever ends, and means for selectively actuating said fluid motor including valve means supported by the engine, a steering cable having a conduit and an inner core longitudinally movable in said conduit, one of said conduit and said inner core being connected to said valve means for actuating said valve means, and a rigid link having opposite ends, one of said link ends being connected to said lever, and the other of said link ends being connected to the other of said conduit and said inner core.

* * * * *